US006283170B1

(12) United States Patent
Robinson

(10) Patent No.: US 6,283,170 B1
(45) Date of Patent: Sep. 4, 2001

(54) ERGONOMIC, LIQUID-TRANSPORT CONTAINER

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 09/405,873

(22) Filed: Sep. 24, 1999

Related U.S. Application Data

(60) Provisional application No. 60/124,114, filed on Mar. 12, 1999, and provisional application No. 60/101,641, filed on Sep. 24, 1998.

(51) Int. Cl.[7] ..... B65B 1/04

(52) U.S. Cl. ..... 141/1; 141/364; 220/735; 15/260

(58) Field of Search ..... 141/1, 364, 311 R; 15/260–264; 222/566, 460; 220/735, 694

(56) References Cited

U.S. PATENT DOCUMENTS

| | | | | |
|---|---|---|---|---|
| D. 156,145 | | 11/1949 | Minnis | D14/3 |
| D. 159,961 | | 9/1950 | Davey | D14/3 |
| D. 305,948 | | 2/1990 | Rentz | D32/53 |
| D. 344,379 | | 2/1994 | Clark, Jr. | 248/128 |
| D. 345,236 | | 3/1994 | Chen | D32/53 |
| 398,410 | | 2/1889 | Laube . | |
| 627,273 | * | 6/1899 | Seibert . | |
| 1,453,450 | | 5/1923 | Dilas . | |
| 1,587,934 | * | 6/1926 | Bartlett . | |
| 1,918,986 | * | 7/1933 | Schulman . | |
| 2,594,176 | * | 4/1952 | Kaiser, Jr. . | |
| 2,895,238 | | 7/1959 | Long | 37/130 |
| 3,722,956 | | 3/1973 | Lee et al. | 298/2 |
| 3,926,452 | * | 12/1975 | Goines | 220/95 |
| 4,319,761 | | 3/1982 | Wells | 280/47.36 |
| 4,769,860 | | 9/1988 | Sargent et al. | 4/321 |
| 4,800,612 | | 1/1989 | Valentine | 15/314 |
| 4,823,428 | | 4/1989 | Sevigny | 15/302 |
| 4,827,562 | * | 5/1989 | Blasé et al. | 15/353 |
| 5,076,252 | * | 12/1991 | Schlosser et al. | 220/744 |
| 5,261,562 | * | 11/1993 | Prout et al. | 220/771 |
| 5,274,877 | * | 1/1994 | Morad et al. | 15/262 |
| 5,333,353 | | 8/1994 | Taylor | 15/264 |
| 5,414,892 | | 5/1995 | Clark, Jr. | 15/263 |
| 5,511,279 | * | 4/1996 | Ippolito | 15/257.06 |
| 5,918,343 | * | 7/1999 | Young | 15/262 |
| 6,053,354 | * | 4/2000 | Neimeyer | 220/819 |

OTHER PUBLICATIONS

White Mop Wringer Company, *100 Years of Quality & Innovation*, White Mop Wringer Company, Tampa, FL., pp. 15, B525719 (no date).

* cited by examiner

*Primary Examiner*—Steven O. Douglas
(74) *Attorney, Agent, or Firm*—Wood, Herron & Evans, L.L.P.

(57) ABSTRACT

In one particular version, the particular ergonomic, liquid-transport container 10 includes a container body 12, a projecting lip 14 extending from the front of the container body 12, a support member 16 connected to the top of the container body 12, a lifting lever arm 18 pivotally connected to the sides of the container body 12 adjacent the back of the container body 12, a pair of non-caster wheels 20, 22 connected to the container body 12 adjacent the back, a pair of caster wheels 24, 26 connected to the container body 12 adjacent the front, and a storage compartment 28 extending from the back. The container 10 advantageously may be used in combination with a cleaning-tool wringer 30 and a cleaning tool 32.

40 Claims, 6 Drawing Sheets

ERGONOMIC, LIQUID-TRANSPORT CONTAINER

CROSS-REFERENCE TO RELATED APPLICATIONS

This application claims the benefit of the filing date of Provisional U.S. Patent Application No. 60/101,641 entitled "Mobile, Liquid-Transport Cart With Ergonomic Design Features" and filed on Sep. 24, 1998, as well as the benefit of the filing date of Provisional U.S. Patent Application No. 60/124,114 entitled "Mobile, Liquid-Transport Cart With Ergonomic Design Features" and filed on Mar. 12, 1999, the entire disclosure of each of these provisional U.S. patent applications being incorporated herein in its entirety by reference.

BACKGROUND OF THE INVENTION

This invention is directed to containers having a liquid reservoir, and in particular, to mobile containers designed to receive one or more liquids in a liquid reservoir, to transport the liquid or liquids, and to drain at least a portion of the liquid or liquids from the container reservoir.

Maintaining the cleanliness of commercial, industrial, institutional, and public buildings is an ongoing effort, and at times, an effort which seems more like a losing battle. This is particularly true for areas such as restrooms, locker rooms, cafeterias, and food service kitchens, where the volume of traffic in the particular area may make it difficult to maintain the cleanliness of the facility.

Building maintenance staff typically clean such areas on a routine basis using traditional mop-and-bucket assemblies, in which the bucket includes a detachable mop wringer, and is positioned on caster wheels, thereby enabling a building maintenance person to move the mop bucket from place to place, typically by pushing on the mop handle. Depending on the cleanliness of the mop, a worker may be able to make a good start in cleaning a floor using the mop bucket system. However, as soon as the worker makes a first pass and wrings the mop out, each time the worker plunges the mop into the bucket and wrings the mop out, both the mop and "cleaning water" become more and more dirty.

One way to aftermpt to solve this problem is to make frequent water and mop changes. However, this adds time to an already laborious process, and therefore, there is little worker incentive to make frequent water and mop changes. In addition, traditional mop buckets have an inadequate pour spout which results in sloppy pouring, and, in many cases, dirty cleaning solution actually splashes onto the worker. Moreover, because a slop sink, source of clean water, or custodial supply room may be far away, a worker is even less inclined to make water and mop changes.

In addition to the limitations discussed above, the use of traditional mop buckets reduces worker productivity. For example because such buckets move on four swivel casters, the buckets do not allow for controlled steering. While such a bucket usually will move in the general direction in which it is pushed, the movement tends to be rather erratic. In order to gain a bit more control when steering the bucket, an operator typically positions a mop in the bucket, grabs the mop handle with both hands, and pushes the bucket in the desired direction by maneuvering the mop handle with both hands. As can be appreciated by those of ordinary skill, this method of "steering" may be quite uncomfortable. Moreover, an operator typically is unable to carry additional items because both hands are positioned on the mop handle for steering. Accordingly, the particular operator must make another trip to a supply closet or other location in order to bring additional items to the location of the mop bucket.

One of the most serious problems affecting worker productivity with regard to the use of mop buckets is the frequent occurrence of back injuries, due typically to the strain placed on an operator's back when lifting a conventional mop bucket filled with water, and/or dumping the water into a sink which, in many instances is elevated, thereby further aggravating the stress on an operator's back. Not only do such back injuries affect the speed with which workers may perform their duties, but such injuries also lead to missed work days. In addition, many back injuries result in employee claims for worker's compensation, thereby increasing overall labor costs for employers.

The end result is that a dirty floor gets cleaned by pushing dirty water around with a dirty mop. At best, the surface may have the appearance of being cleaned if concentrated spots of highly visible soil have been removed or spread around. In reality, however, given the limitations of these tools, the worker still is simply pushing dirt around the floor, as evidenced by the "five-o'clock shadow" of dirt seen frequently along the surface of walls adjacent the floor, as well as the "finger painting-like streaks" left by the mop when the water on the floor dries.

The cleanliness problem may be especially severe in the restrooms of these various buildings, and in fact, the number-one building maintenance complaint is dirty restrooms. Given the frequency with which these facilities are used, as well as the tools available for cleaning restrooms, the dirty restroom complaint is not particularly surprising. Building maintenance workers typically use the mop-and-bucket system described above to clean restroom floors. And, as noted above, while this system may pick up some dirt, it tends more typically to spread dirty water around on the floor.

Accordingly, given the relative ineffectiveness and/or inefficiency of the various mop buckets available, particular facilities are not cleaned as well or as frequently as they should be, and morale and job satisfaction among many building maintenance professionals are relatively low.

SUMMARY OF THE INVENTION

The present invention overcomes the above-mentioned drawbacks by providing an ergonomic, liquid-transport container, as well as a method of pouring a liquid from such a container into a receptacle having a rim. To this end, one aspect of the invention is directed to a container having a container body which includes a liquid reservoir and a front. The container also has a projecting lip which extends from the front, with the projecting lip having a bottom exterior surface and an outer end, with the bottom exterior sur face having a hook-shaped curve. The hook-shaped curve is extremely beneficial in that it enables an operator to pour liquid from the container into any of a number of different receptacles, simply by positioning the hook-shaped curve on the rim of the receptacle, and elevating the back of the container body, thereby pouring at least a portion of the liquid from the container into the receptacle.

Because the hook-shaped curve works well with toilet bowl rims of virtually any shape and size, a worker may drain liquid from a liquid reservoir directly into a toilet, without having to move the container back to a custodial closet floor drain or slop sink. Accordingly, if an operator is using the container to hold a liquid cleaning solution, the operator is more likely to make more frequent cleaning liquid changes, since a toilet will be more readily accessible.

If desired, the bottom exterior surface of the projecting lip may be substantially planar across its width. And, advantageously, the outer end of the projecting lip is at least about two inches from the front of the container body. Also, the bottom exterior surface width may taper from the front of the container body to the outer end of the projecting lip. The container body, itself, has an upper peripheral end and a lower peripheral end, and may have a part of the front of the container body, between the projecting lip and the lower end, which is substantially planar. Furthermore, the hook-shaped curve may be a substantially smooth curve, i.e., a curve having a constant radius, and, in one version of the invention, the radius may be about 1½ inch.

The various features described above assist in providing a smooth and stable movement as the container is rotated approximately 90° about the rim of the particular receptacle from an initial substantially horizontal position. For example, if the receptacle is a toilet bowl, these features assist the user in smoothly rotating the bottom exterior surface of the projecting lip about the toilet bowl rim. And in those versions of the invention which include a tapered bottom exterior surface, the contact points between the container and the toilet bowl rim widen as the worker continues to rotate the container. In the container version in which at least a part of the container body front is substantially planar, this portion of the front makes maximal contact with the toilet bowl rim once the container has reached the approximately 90° rotation point. Another benefit of the hook-shaped curve is that it minimizes, and even eliminates, the problem of splashing frequently associated with the draining of mop buckets.

If desired, the projecting lip, itself, also may serve as the conduit or channel through which a liquid is poured from the container. Alternatively, the container may include a separate projection which serves, at least in part, as the channel or conduit. This projection also extends from the front of the container body and includes a bottom wall portion and an outer end.

Regardless of whether the projecting lip includes the projection, or the projection is a separate element, the projection bottom wall portion may include an interior surface, with the interior surface curving toward the lower end of the container front, as the projection bottom wall approaches the front of the container body. This curve along the upper surface of the projection bottom-wall portion assists in draining liquid from the liquid reservoir of the container. If desired, the projection also may include a first sidewall portion and a second, oppositely disposed, sidewall portion. In addition, the container body may further include a first side and a second side, with each of the projection first and second sidewall portions having a sidewall interior surface. Advantageously, the first sidewall interior surface may curve toward the first side, and the second sidewall interior surface may curve toward the second side, as the projection first and second sidewalls approach the front of the container body. As discussed above with regard to the interior curvature of the surface of the projection bottom wall portion, the curvature of these sidewall interior surfaces also facilitates the drainage of liquid from the container. In addition, if desired, the projection may further include a top wall portion.

In another aspect, the container has a spout extending from the front of the container body, with the spout having a hollow, elongated tube having an outer end and an inner end, with the inner end being adjacent the front of the container body. Although this particular version has a peripheral sidewall which is typically closed when viewed in cross-section, the "tube" need not be circular in cross-section. For example, at any given point along the length of the spout, the cross-sectional shape of the tube may be a closed curve of any desired shape, or a polygon of any desired shape. Moreover, the cross sectional shape and/or dimensions of the tube may vary along the length of the spout. Advantageously, the inner end of the spout is above the standard liquid fill-line of the liquid reservoir. In this fashion, when the container is in a non-pouring position, e.g., oriented in a substantially horizontal position on a floor, liquid contained in the liquid reservoir will not enter into, or flow out of, the spout. In further detail, the "standard liquid fill-line" refers to the maximum optimal height of the particular liquid or liquids in the container. This maximum optimal height is a height which is adjacent, or just below, the bottom wall of a wringer when the wringer is positioned on the container In a further aspect, the container includes a peripheral sidewall, a peripheral lower end, and a peripheral upper end, with the upper and lower ends being adjacent the peripheral sidewall. In further detail, the peripheral sidewall has a front, a back, a first side, and a second, oppositely disposed, side. The terms "front", "back", and "side" provide relative orientations only, and do not necessarily indicate a separate wall or walls, connected together by a particular angle, unless specifically stated otherwise. For example, these terms may be used to refer to relative locations along a container body, in which the container body is substantially cylindrical, or in which the horizontal, cross-sectional shape of the peripheral sidewall forms a closed curve. Advantageously, the peripheral upper end has a first opening which provides access to the liquid reservoir, and which is sized to accept a portion of a wringer, a cleaning tool, or both.

Advantageously, the container further includes a support member extended between, and connected to, the first and second sides, with the support member constructed and arranged to support an edge of a wringer. In one version, the support member is spaced from the back of the peripheral sidewall sufficient to support an edge of a wringer when the wringer is positioned adjacent the back of the peripheral sidewall. While in another version, the support member may be spaced from the front of the peripheral sidewall sufficient to support an edge of a wringer when the wringer is positioned adjacent the front of the peripheral sidewall. Advantageously, the support member is positioned adjacent the peripheral upper end of the container body, such that an upper surface of the support member supports the lower surface of a projecting lip along the front side of the wringer, when the wringer is positioned on the container. The support member, itself, offers several benefits and advantages. For example, the support member serves to confine the forward face of the wringer and essentially lock the forward face into position during wringing. In addition, the support bar becomes the pivot point of movement of the wringer. Accordingly, when an operator applies a downward force on the wringer handle during the wringing action, the force is countered by the opposing force of the support bar, thereby greatly reducing, and in some instances, even eliminating, the force exerted by the wringer on the back of the peripheral sidewall of the container body. Because the support bar, as opposed to the back of the peripheral sidewall, bears most of the force when a user wrings liquid from a cleaning-tool, the container body, itself, may be significantly thinner than a conventional liquid transport container, such as a mop bucket, for example. As will be appreciated, this reduced thickness likewise reduces the weight of the container, thereby making it even easier for a worker to use the container. In addition, when the wringer is removed from the container, the support member serves as a lift handle for convenient movement of the container.

In another aspect, the container includes a lever arm, also referred to as a lifting a lever arm, with the lifting a lever arm being constructed and arranged to extend beyond the back of the container body. The lifting lever arm, itself, has an outer end, and advantageously, the distance between the outer end and the back of the container body may be adjustable. If desired, the lifting lever arm is pivotally connected to the container body, and the lifting lever arm beneficially may have one or more extended positions and one or more non-extended positions. The lifting lever arm is particularly useful in assisting a worker in the process of pouring liquid from the liquid reservoir into a receptacle. As will be appreciated by those of ordinary skill in the art, the lever arm increases the length of the lever inherently present in the container, thereby increasing mechanical leverage for a worker, as a worker elevates the back of the container in order to drain liquid from the liquid reservoir. In fact, in one version of the container, the effort, or lifting force, required by a worker to elevate the container for draining actually is reduced by about one third at the point in the bucket rotation process where the maximal lifting force is required. And because the lifting lever arm extends further beyond the back of the container when the lifting lever arm is in an extended position, a user is able to stand behind the container, and generate the vast majority of the lifting force by using his or her legs, as opposed to his or her back, thereby creating an ergonomic lifting position, and reducing the strain on the worker. This mechanical-leverage aspect of the container, which results in relatively easy draining of liquid, allows a custodian or other operator to put larger quantities of liquid into the container with confidence, knowing that he or she will be able to drain the liquid safely, despite the additional weight of the liquid. And because larger quantities of liquid may be used, depending upon the particular activity being performed by a worker, the worker may cover a larger surface area before having to refill the container, thereby further increasing worker productivity. As used in conjunction with the lifting lever arm, the term "extended" refers simply to a position in which the distance between the outer end of the lifting lever arm and the back of the container body is increased, thereby extending the length of the lifting lever arm. In contrast, the term "non-extended", in conjunction with the lever arm, refers to a lever-arm position in which the outer end of the lever arm is closer to the back of the container body than it is when in an extended position.

In yet a further aspect, the container includes a first wheel and a second wheel, with the first and second wheels being non-caster wheels, e.g., fixed wheels. This feature enables an operator to move the container from one location to another with greater ease. Furthermore, unlike traditional containers, because these wheels are non-caster wheels, they serve to provide a pivot point, thereby enabling an operator actually to steer the container, including, for example, turning the container to the left or to the right. Advantageously, the first and second wheels may be connected to each other and to the container by an axle which passes through the container. Beneficially, the container may further include a third wheel, and, if desired, a fourth wheel. In this case, the additional wheel or wheels preferably are caster wheels. This aspect of the container offers a tremendous benefit to a user, in that the user may roll the container from one location to another with ease. In addition, while the handle of a particular cleaning tool may be used to steer or move the container, a wringer may be used to advantage. In further detail, because a wringer has a handle which is used to drive wringer plates onto a mop or other cleaning tool, this handle serves as an excellent steering handle, also referred to as a steering lever arm. Moreover, because this aspect of the container includes first and second non-caster wheels, a user easily may steer and move the container with one hand, thereby freeing the other hand to carry additional implements, which further enhances worker productivity.

In another aspect, the back of the container may have a storage compartment. Advantageously, the storage compartment includes a receptacle which is oriented backward at an angle relative to a horizontal reference plane, with this backward angle assisting in maintaining the contents of the storage compartment within the receptacle, even when the back of the container is elevated so as to drain the contents of the liquid reservoir. Depending on the size of the storage compartment, it conveniently may store several gallon jugs of various cleaning fluids, as well as cleaning tools, and even a liquid fill hose (to be discussed momentarily). In this fashion, an operator may keep frequently used items with the container itself, thereby eliminating the need to return to a storage closet for various supplies. As used in conjunction with the receptacle, the "horizontal reference plane" refers to any horizontal surface, including, for example, a floor.

In another aspect of the container, the peripheral upper end has a top panel adjacent the back of the peripheral sidewall, with the top panel including a second opening. The second opening beneficially is positioned between the upper end's first opening and the back of the peripheral sidewall, with the second opening not only accessing the liquid reservoir, but also being sized so as to receive a liquid fill hose. The liquid fill hose, also referred to as a liquid transport device, is particularly advantageous because it allows an operator to fill the liquid reservoir virtually anywhere a faucet is located. For example, if a restroom is being cleaned, a restroom sink faucet may be used, with one end of the liquid fill hose being connected to the faucet, and the other end being passed through the second opening of the container. Additional details regarding one version of the liquid fill hose (liquid transport device) may be found in co-pending U.S. patent application Ser. No. 09/108,411, entitled "Multi-Functional Cleaning Machine" and filed on Jul. 1, 1998, the entire disclosure of that application being incorporated herein by reference.

In a further aspect of the container, a wringer used in conjunction with the container may include a cleaning-tool stowing assembly. The stowing assembly comprises a strap having a first end and a second end, with the first end being secured to a portion of the wringer, and the second end being releasably securable to an adjacent portion of the wringer. This stowing assembly is especially beneficial in releasably securing the handle of a cleaning tool, so that an operator does not have to hold or reposition such a handle to prevent it from falling down. Additional details regarding a version of the cleaning-tool stowing assembly may be found in copending U.S. patent application Ser. No. 09/108,411.

In another aspect of the container, a wet/dry vacuum assembly is included, thereby enabling an operator to take advantage of the easy liquid-draining features of the container, and to vacuum up liquid and/or solid materials. Advantageously, the vacuum assembly comprises: a wet/dry vacuum power unit for releasable sealing engagement with the peripheral upper end of the container body; a vacuum hose for releasable sealing connection to the container body inlet port or to the container body spout; and a sealing member for releasably sealing the spout or the inlet port.

These and other benefits and advantages of the present invention will be made apparent from the accompanying drawings and detailed description of the drawings.

BRIEF DESCRIPTION OF THE DRAWINGS

The accompanying drawings, which are incorporated in, and constitute a part of, this specification, illustrate embodiments of the invention and, together with the general description of the invention given above, and the detailed description of the drawings given below, serve to explain the principles of the invention.

DETAILED DESCRIPTION OF THE DRAWINGS

Figure 1:
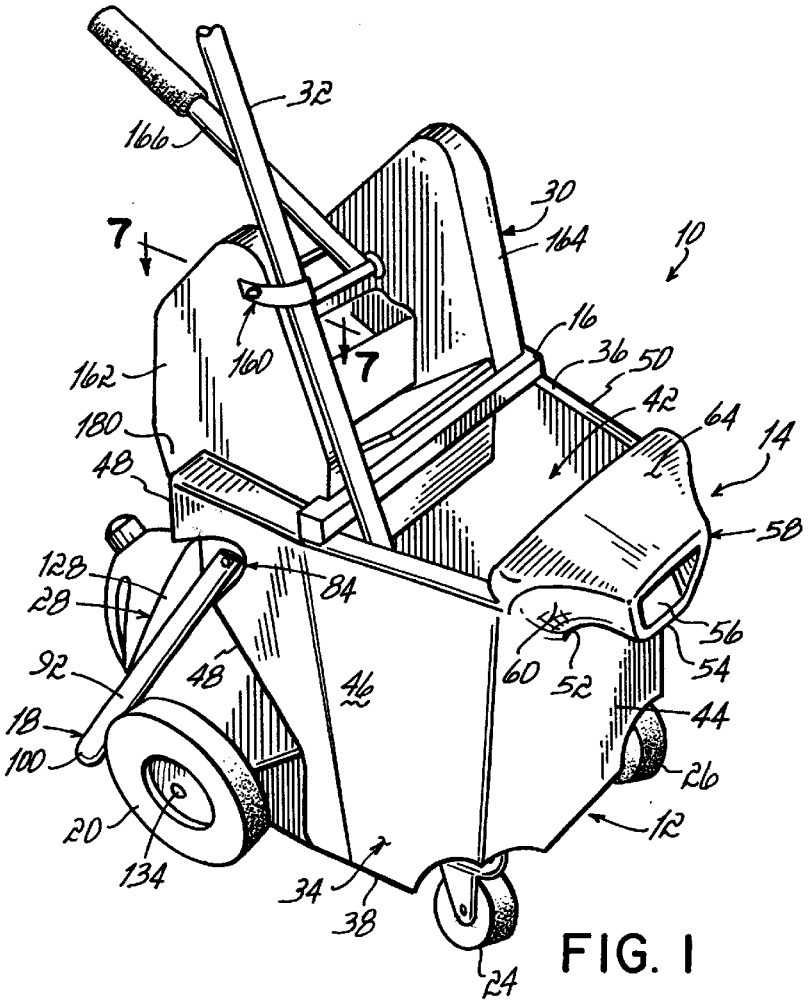
FIG. 1 is a perspective view of a version of the ergonomic, liquid-transport container, in combination with a cleaning tool and wringer.

With reference to FIG. 1, the particular ergonomic, liquid-transport container 10 shown includes a container body 12, a projecting lip 14 extending from the front of the container body 12, a support member 16 connected to the top of the container body 12, a lifting lever arm 18 pivotally connected to the sides of the container body 12 adjacent the back of the container body 12, a pair of non-caster wheels 20, 22 connected to the container body 12 adjacent the back, a pair of caster wheels 24, 26 connected to the container body 12 adjacent the front, and a storage compartment 28 extending from the back. The container 10, itself, is shown in combination with a cleaning-tool wringer 30 and a cleaning tool 32.

In further detail, the container body 12 includes a peripheral sidewall 34 having a peripheral upper end 36 and a peripheral lower end 38, as well as a bottom wall 40. In combination, the peripheral sidewall 34 and bottom wall 40 form a liquid reservoir 42 capable of holding and supporting a liquid. As shown, this peripheral sidewall 34 includes four readily identifiable sidewall components, namely, a front wall 44, a first sidewall 46, a back wall 48, and a second sidewall 50. However, the peripheral sidewall need not be articulated in such a defined fashion. Instead, for example, the peripheral sidewall may have a cylindrical shape, a funnel-like shape, or any other suitable shape, as will readily be appreciated by those of ordinary skill in the art.

With the particular ergonomic, liquid-transport container 10 shown in FIG, 1, the projecting lip 14 is not only the projecting lip referred to in the claims, but also is the projection referred to in the claims. Accordingly, in this version 10, the projecting lip and the projection are the same element 14, having a bottom exterior surface 52 and an outer end 54. However, it should be noted that, in other versions of the container, the projecting lip and the projection may be entirely different elements.

As seen in FIG. 1, the projecting lip 14 actually forms a bottom wall portion 56 of a pouring spout 58. As best seen by looking at FIGS. 1–4 in combination, the spout 58 has not only the bottom wall portion 56, but also a first sidewall portion 60, a second, oppositely disposed, sidewall portion 62, and a top wall portion 64. Each of these four wall portions tapers from a spout inner end 66, adjacent the front wall 44 of the container body 12, toward a spout outer end 68. In further detail, the bottom exterior surface 52 of the spout 58 has a hook-shaped curve 70 which is substantially smooth, meaning that, the curve 70 has a relatively constant radius. As shown, the bottom exterior surface 52 of the spout 58 has a radius of about 1½ inch, and the outer end 68 of the projecting lip 14 of the spout 58 extends outward approximately three inches from the front wall 44 of the container body 12. However, it should be understood that these dimensions are exemplary only, and that any suitable dimensions may be used. The bottom exterior surface 52 of the spout 58 is substantially planar across its width (e.g., forms a smooth, elongated arc or trough, like a lengthwise section of a hollow, elongated cylinder), thereby providing smooth contact with, and smooth pivoting about, the rim of a receptacle, such as a rim 72 of a toilet bowl 74, for example. Depending upon the rim of the particular receptacle, the bottom exterior surface 52 of the spout 58 initially may have either one point of contact, or two points of contact with the particular rim, either of which provides for a smooth and stable movement as the back of the container 10 is elevated and liquid is poured from the liquid reservoir 42 into the particular receptacle. As the back of the container 10 is elevated further, and with reference to FIGS. 3 and 4, the point or points of contact will tend to move downward along the bottom exterior surface 52 of the spout 58, and eventually to the planar front wall 44 of the container body 12. Accordingly, once the container 10 has been rotated approximately 90°, as shown in FIG. 4, from a horizontal starting position, as shown in FIG. 2, the container 10 forms a stable, wide, contact area with the rim 72 of the toilet bowl 74, as is shown by the cross-hatching in FIG. 4, which shows the contact area between the front wall 44 of the container body 12 and the rim 72 of the toilet bowl 74.

As best seen in FIGS, 3, 4, and 6, the spout 58 also includes a contoured interior surface. In further detail, the interior surface 76 of the bottom wall portion 56 curves generally downward in the direction of the front wall peripheral lower 38 end, as the bottom wall portion 56 approaches the front wall 44 of the container body 12. In addition, the interior surface 78 of the spout first sidewall portion curves laterally away from a vertical center line 80 of the spout 58, toward the first side wall 46 of the container body 12, while the interior surface 82 of the spout second sidewall portion 62 curves laterally away from the spout vertical center line 80 toward the second sidewall 50 of the container body 12. These curves assist in providing for a smooth pouring operation, as they tend to act in a funnel-like fashion, gradually directing liquid toward the outer end of the of the spout, and minimizing any tendency toward abrupt movement of the container as it is being rotated.

Figure 2:
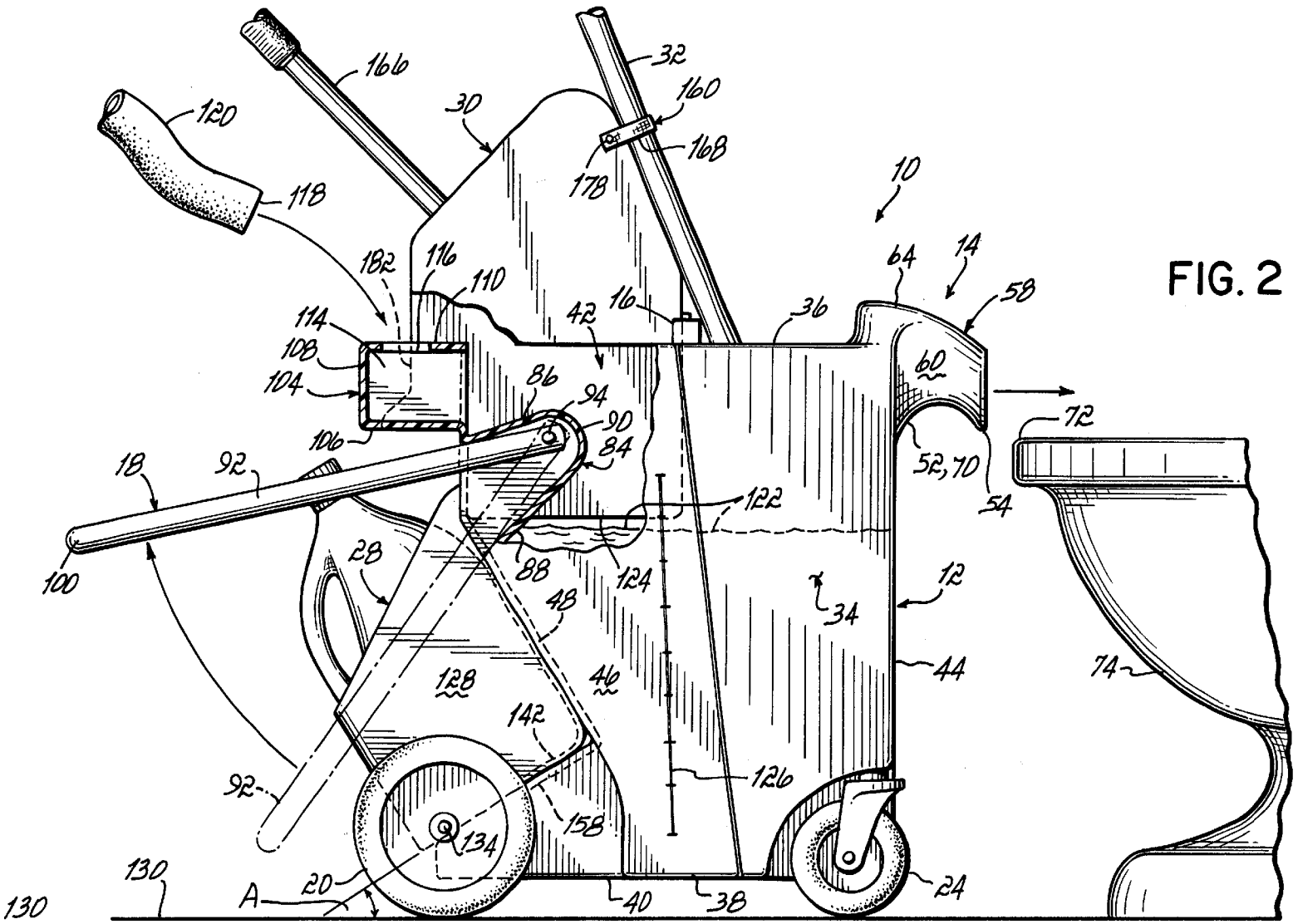
FIG. 2 is a side, partially broken-away view of the combination of FIG. 1, with the container adjacent a rim of a toilet bowl.
Figure 5:
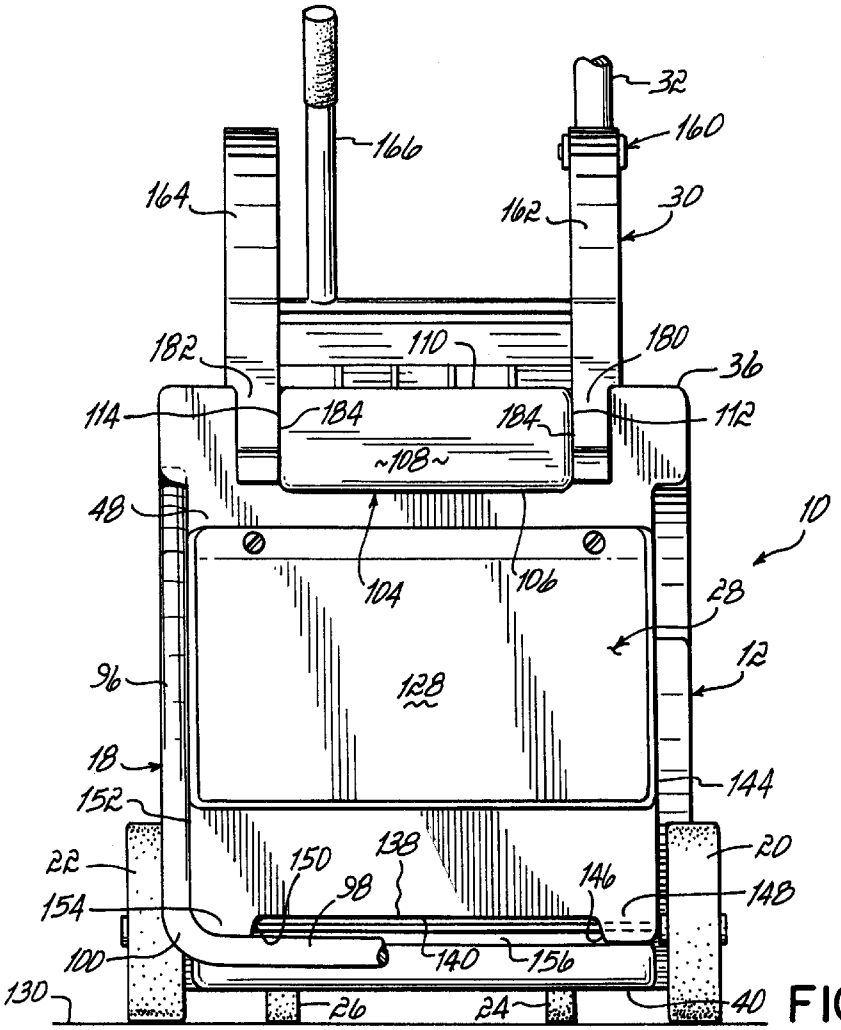
FIG. 5 is a back, partially broken-away view of the combination of FIG. 1.
Figure 6:
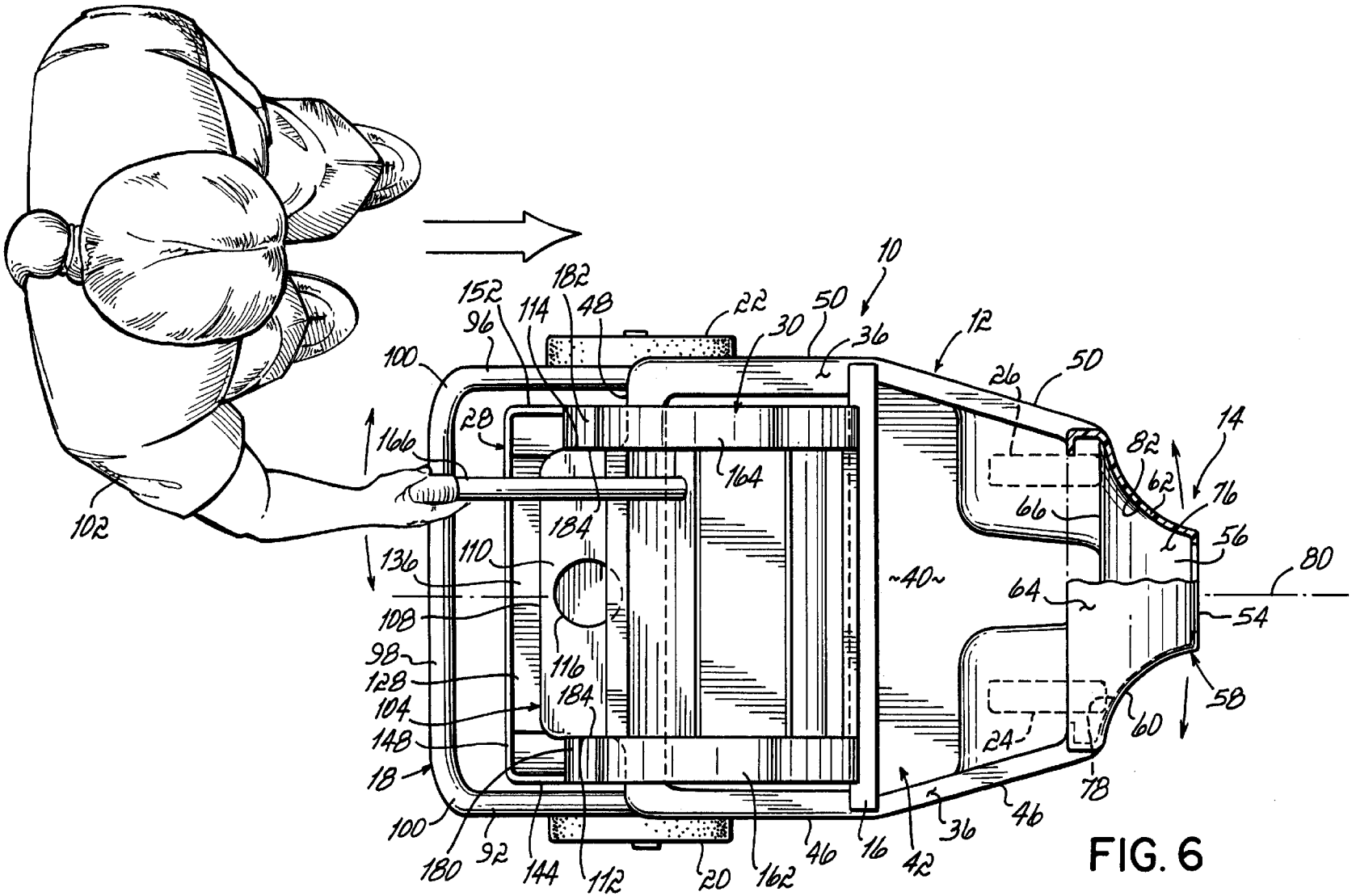
FIG. 6 is a top view of the container and wringer of FIG. 1, in combination with an operator.

With regard to FIG. 2, the ergonomic, liquid-transport container 10 is shown adjacent a toilet bowl 74. As shown, the lever arm 18 is pivotally connected to the first sidewall 46 and second sidewall 50 (not shown). More specifically, each of the first and second sidewalls 46, 50 of the container body 12 has a recess 84 including an upper edge 86, a lower edge 88, and a base 90 positioned between the upper and lower edges 86, 88. As best shown in FIG. 2, viewed in conjunction with FIG. 6, the lever arm 18, itself, includes a first bar portion 92 having an inner end 94, with the first bar portion being pivotally connected to the recess 84 of the first sidewall 46, adjacent the base 90 of the recess 84. The second bar portion 96 is pivotally connected to the recess 84 (not shown) on the second sidewall 50 of the container body 12, in like fashion. In addition, the first and second bar portions 92, 96 are connected to a back bar portion 98 at their respective outer ends 100. In FIG. 2, the lever arm 18 is shown in an extended position, and also is shown in phantom in a non-extended position. As seen in this view, when the lifting lever arm 18 is in a non-extended position, a segment of each of the first and second bar portions 92, 96 rests on a part of the respective lower edges 88 of the recesses, and in this position, the lifting lever arm 18 is maintained in non-contacting relationship with the wheels 20, 22, while also remaining close enough to the back wall 48 of the container body 12 so as not to interfere with the movement of an operator 102 who is steering and moving the container 10, as shown in FIG. 6. Prior to draining liquid from the container liquid reservoir 42 into a receptacle, a user may extend the position of the lifting lever arm 18, for example, simply by lifting a bar side portion 92, 96 or back portion 98, thereby rotating the lever arm 18 about its two pivot points on the sidewalls 46, 50 of the container body 12. As shown in FIG. 2, when the lever arm 18 is raised to its most extended position, a section of each of the bar side portions 92, 96 rests against a part of the upper edge 86 of the corresponding recess 84, thereby providing an upper stop point or brace point, so that an operator may begin to elevate the rear of the container 10, thereby beginning to pour liquid from the liquid reservoir 42 into the appropriate receptacle. As further seen in FIG. 2, this movement of the lifting lever arm 18 from its maximal non-extended position to its maximal extended position is a smooth movement, and, as best shown in FIGS. 2, 5, and 6, is one which is not impeded by the storage compartment 28, either with or without various bottles, jugs, or other cleaning items.

FIG. 2 also provides a good view of a back wall projection 104, which extends rearward from the back wall 48, adjacent the upper peripheral end 36 of the container body peripheral sidewall 34. With combined reference to FIGS. 2 and 6, this back wall projection 104 includes a bottom panel 106, back panel 108, top panel 110, and first and second side panels 112, 114. In addition, the top panel 110 includes a centrally positioned second opening, which advantageously is circular in shape, and which serves as a liquid fill port 116. Accordingly, in order to fill the liquid reservoir 42 of the container body 12, an outer end 118 of a liquid fill hose 120 may be inserted through the liquid fill port 116 and into the back wall projection 104, while an inner end (not shown) of the liquid fill hose 120 may be connected to a faucet, spigot, or any other suitable source of liquid. The liquid fill hose 120, also referred to as a liquid transport device, is described in greater detail in copending U.S. patent application Ser. No. 09/108,411, entitled "MULTI-FUNCTIONAL CLEANING MACHINE" and filed on Jul. 1, 1998. When a liquid fill hose 120 is used, an operator may fill the liquid reservoir 42 virtually anywhere a faucet, spigot, or other similar liquid dispensing device exists. This feature creates a phenomenal advantage for an operator, in that any location having such a liquid source instantly becomes a custodial closet, thereby eliminating the need to have to return to a custodial closet in order to fill the liquid reservoir 42 once it has been drained. Moreover, if the container 10 is being used in a room or other area which includes not only such a source of liquid, but also a liquid draining receptacle, then a worker may not only use the liquid in the liquid reservoir 42 for the particular application at hand, but he or she also may drain any remaining liquid from the container 10, as well as refill the container 10, without ever having to leave the particular work area, thereby greatly enhancing productivity.

With reference to FIG. 2, the liquid reservoir 42 has a standard liquid fill line 122 which typically is adjacent, or just below, a bottom wall 124 of the wringer 30. In this fashion, a user may take full advantage of the carrying capacity of the liquid reservoir 42, while simultaneously assuring that the particular cleaning tool being used is not inadvertently re-wetted during the wringing process. Advantageously, this standard liquid fill line 122 meets the front wall 44 of the container body 12 at a position which is approximately two inches below the inner end 66 of the spout 58. However, as will readily be understood by one of ordinary skill, this standard liquid fill line 122 may vary depending on the particular wringer being used. Moreover, if the container 10 is being used for an application which does not require wringing of the particular cleaning tool, then a worker may fill the liquid reservoir to a higher level, with the only meaningful limitation being the point at which the water line reaches the upper most point of the interior surface of the spout bottom wall portion 56. As shown, the first sidewall 46 of the container body 12 also includes liquid-level gradations or markings 126 to assist a user in determining the amount of liquid present in the reservoir 42

As best shown in FIGS. 1 and 2, the storage compartment 28 includes a receptacle 128 which is oriented backward, at an angle "A" relative to a horizontal reference plane 130. In this fashion, even when the container 10 is rotated about the rim of a reservoir, as shown, for example in FIG. 3, the contents of the storage compartment 28 will not fall out of the receptacle 128. This is true, not only when the container 10 is rotated 90°, as shown in FIG. 3, such that the planar front wall 44 is substantially horizontal with the floor, but also is the case even if the container 10 is rotated slightly passed this "over center" point so as to direct any remaining bit of liquid from the interior surface 132 of the front wall 44 toward and out of, the pour spout 58.

As shown in FIG. 2, the exterior surface 52 of the bottom wall portion 56 of the spout 58, even at the spout's outer end 54, is slightly higher than the rim 72 of the toilet bowl 74. Accordingly, with the particular combination shown, the container 10 may simply be rolled forward until the spout 58 is positioned over the toilet bowl rim 72. In one version of the container, the distance from the exterior bottom wall of the spout at the spout outer end to the floor is about 16½ inches. However, as will readily be appreciated by one of ordinary skill in the art, the distance from the floor to the upper surface of a rim of a toilet bowl typically will be in the range of about 12 inches to about 19 inches, depending upon the particular toilet bowl. Accordingly, if the container is drained into a toilet bowl having a rim upper surface which is more than about 16½ inches above the floor, as may be the case, for example, with a toilet fixture in a restroom or stall which is wheel chair accessible, an operator easily may grasp a portion of the container, and lift the outer end of the spout over the rim of the particular toilet bowl. Depending upon the specific height of such a toilet bowl, the front wheels of the container may or may not be raised above the ground. In either case, the container, including the spout, is sufficiently strong, so that the spout may bear the load exerted by the container, including any liquid in the liquid reservoir.

Figure 3:
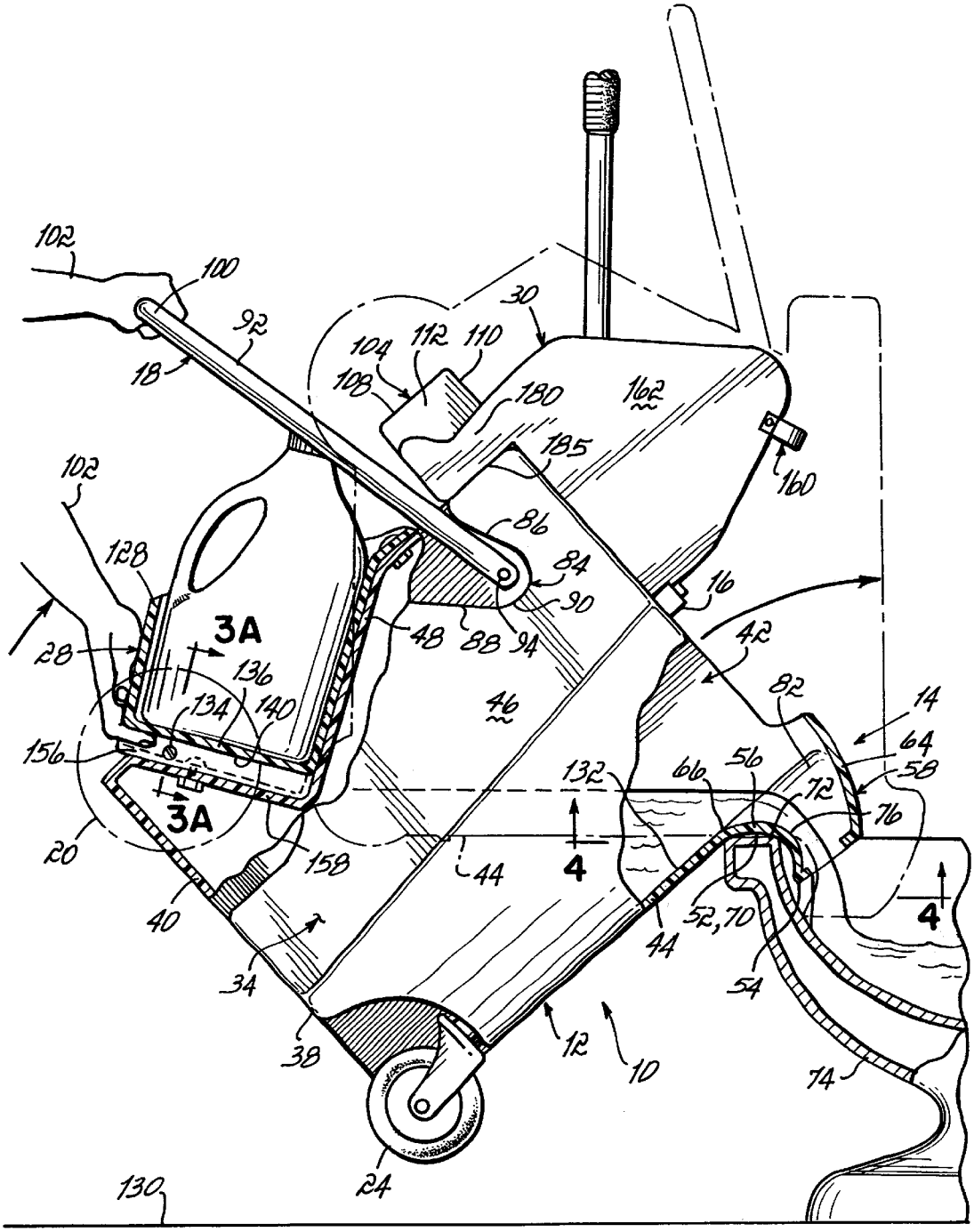
FIG. 3 is a side, partially broken-away view of the container of FIG. 1 in combination with a wringer, with the container contacting the rim of a toilet bowl.
Figure 3A:
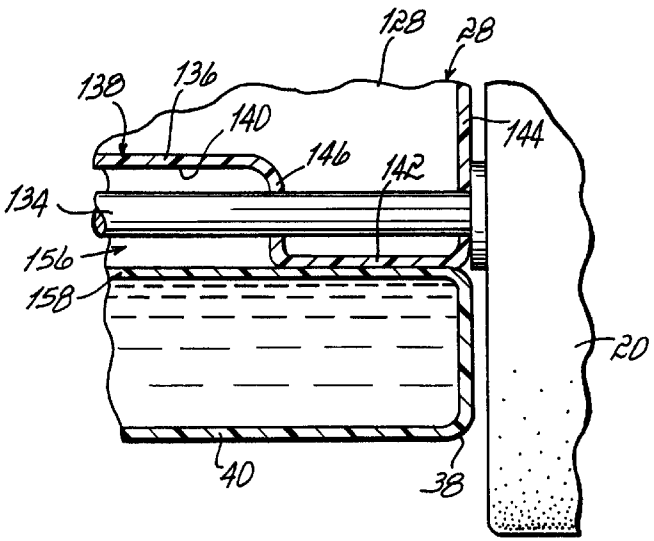
FIG. 3A is a partial, cross-sectional view of a portion of the container of FIG. 1, taken along line 3A—3A of FIG. 3.
Figure 4:
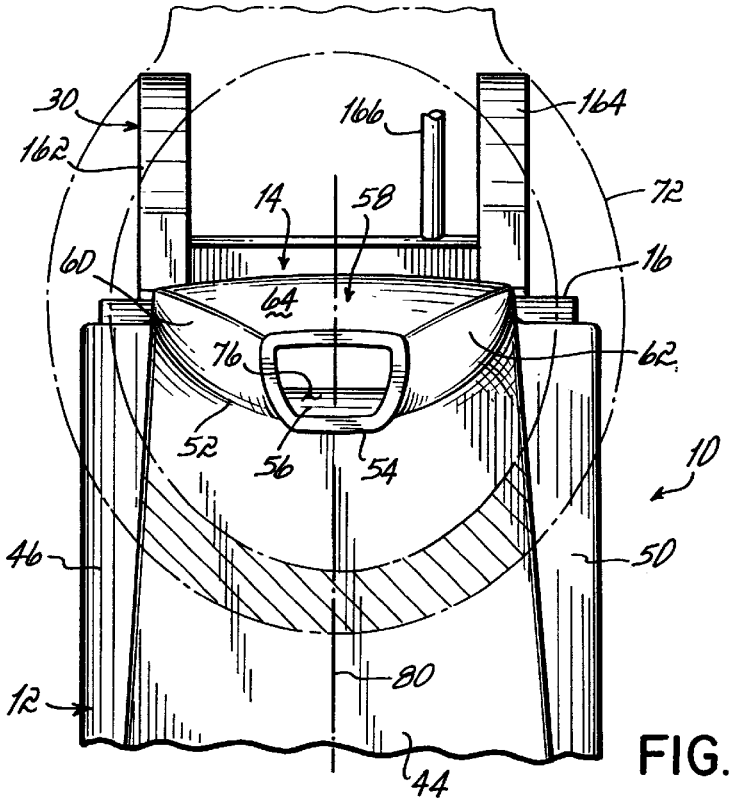
FIG. 4 is front view of a portion of the container and wringer of FIG. 1, taken along line 4—4 of FIG. 3, with the container contacting the rim of a toilet bowl.

As best shown in FIGS. 3, 3A and 5, the first and second wheels 20, 22 are connected to each other by an axle 134, with the axle 134 passing through a lower region of the storage compartment 28 at four different points, thereby offering a great deal of stability to the axle 134 and to the first and second wheels 20, 22. In further detail, a storage compartment bottom wall 136 has a central region 138 in which the bottom wall portion 140 is higher than the bottom wall portion 142 on either side of this central region 138. Accordingly, as best shown in FIG. 5, the axle 134 extends through the first wheel 20, through an exterior sidewall 144 and out an interior sidewall 146 of a first bottom wall portion 148, beneath the bottom wall portion 140 of the central region 138, through the interior sidewall 15O and exterior sidewall 152 of the second bottom wall portion 154, and through the second wheel 22. Not only does this feature add structural integrity to the axle 134 and rear wheels 20, 22, but it also provides a gap or recess 156 between the central region bottom wall portion 140 and an interior upper wall 158 of the container body 12. As seen in FIG. 3, if desired, this gap 156 may be used as an optional hand-hold when maneuvering the container.

Figure 7:
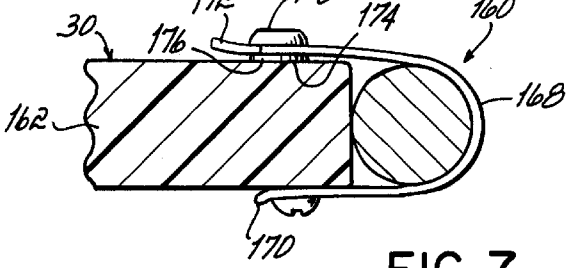
FIG. 7 is a partial cross-sectional view of a cleaning-tool stowing assembly, taken along line 7—7 of FIG. 1.

With reference to FIGS. 1 and 7, the ergonomic, liquid-transport container system further includes a cleaning-tool stowing assembly 160. More specifically, a cleaning-tool stowing assembly 160 advantageously is positioned on a sidewall 162 of t he particular wringer 30 being used, with the sidewall 162 preferably being a sidewall 162 opposite the wringer sidewall 164 which is adjacent the wringer handle 166. In further detail, and as best shown in FIG. 7, the cleaning-tool stowing assembly 160 includes a strap 168 having a first end 170 and a second end 172, with the first end 170 being secured to a portion of the wringer sidewall 162 using any type of suitable fastener, and the second end 172 being releasably securable to an adjacent portion 174 of the wringer sidewall 162. The second end 172 may be releasably secured using any suitable material, including, for example, a female snap member 176 fixed to the wringer sidewall 162 and a corresponding male snap member 178 fixed to the second end 172 of the stowing assembly 160, or corresponding pieces of Velcro®.

As the name suggests, the ergonomic, liquid-transport container is designed with the operator in mind. In further detail, the container allows an operator to perform his or her tasks more effectively, more efficiently, and more safely. In other words, in using the container, an operator is able to achieve cleaner results, in less time, with far less strain on the operator's body, and especially on the operator's back. By way of example, use of the container will now be described in conjunction with cleaning a restroom floor. However, it should be understood that use of the container is, in no way, limited to such a setting. Accordingly, although a restroom faucet and toilet will be used in describing a liquid source and liquid receptacle, those of ordinary skill in the art will readily appreciate that the container may be used in virtually any setting in which it is desirable to transport and/or drain a liquid in an efficient and ergonomic manner. Accordingly, in the exemplary restroom setting, an operator 102 may steer and push the container 10 as shown in FIG. 6, simply by positioning himself or herself behind the container 10 and adjacent the wringer handle 166. This wringer handle 166, also referred to as a steering lever arm, enables the operator 102 to steer and move the container 10, either with or without a liquid in the liquid reservoir 42, with great ease. For example, and as shown in FIG. 6, the operator 102 steers and moves the container by grasping the outer portion of the steering lever arm 166 with his or her right hand, thereby leaving the left hand free to carry additional cleaning items. In moving or steering the container 10, the operator 102 pushes forward, to the left, or to the right, depending upon the desired direction of travel.

As best seen in FIGS. 5 and 6, the force exerted on the steering lever arm 166 by the operator 102 is transferred to the container 10 through various components of the wringer 30, and of the container 10 itself. In further detail, a force exerted on the wringer handle 166, or steering lever arm, is transferred to the first and second legs 180, 182 of the first and second wringer sidewalls 162, 164. Each leg has an inner surface 184 and a front surface (not shown), with the inner surface 184 transferring the force to the adjacent side panel 112, 114 of the container back wall projection 104, and the front surface transferring the force to the container back wall 48, itself. In this fashion, the operator 102 is able to maneuver the container 10 with great ease. If the liquid reservoir 42 is empty, the operator 102 may guide the container 10 to a restroom sink (not shown), and fill the liquid reservoir 42 by positioning the outer end 118 of the liquid fill hose 120 through the liquid fill port 116 and into the back wall projection 104, attaching the inner end of the liquid fill hose 120 to the faucet, and turning on the faucet. If particular chemical additives are to be used, the operator may add such additives to the liquid reservoir 42, at any time, either through the first opening 186, or, if the second opening (liquid fill port) 116 is available, then alternatively through the second opening 116. At this point, the operator 102 may move the container 10 to a suitable location in the restroom, open up the cleaning-tool stowing assembly 160, remove the mop from the container 10, and proceed to mop the restroom floor, wringing the mop out using the wringer 30, as required. If the cleaning solution in the liquid reservoir 42 has been used to clean other restrooms, the operator 102 may need to drain the cleaning solution, and fill the liquid reservoir 42 with fresh cleaning solution prior to completing the mopping process. However, because of the capacity of the liquid reservoir 42, as well as the size of most commercial-scale restrooms, it is unlikely that an operator 102 will need to drain the cleaning liquid solution until after the entire restroom floor has been completely mopped. In fact, in many situations, it will be possible to thoroughly clean several restroom floors before having to drain the cleaning solution from the container 10.

When the operator 102 is ready to drain the cleaning liquid from the container 10, the operator 102 grabs the container's steering lever arm 166 and drives the container 10 up to any nearby toilet, as shown in FIG. 2. Then, with reference to FIGS. 3 and 4, the operator 102 guides the container 10 forward so that the spout 58 is positioned on or above the rim 72 of the toilet bowl 74. At this point, in order for the operator 102 to take maximum advantage of the ergonomic features of the container 10, the operator 102 should remove the mop from the container 10, if he or she has not already done so. In addition, if desired, the operator may remove the wringer from the container, as the wringer handle, or steering lever arm is not needed for this portion of the draining process. Then, in order for the operator 102 to take maximum advantage of the ergonomic features of the container 10, the operator 102 should stand squarely behind the container 10, grasp the back bar portion 98 of the lifting lever arm 18 by bending at the knees and lifting the lever arm 18 from a non-extended position to an extended position, and, using the force of his or her legs, exert an upward force on the lifting lever arm 18 while standing upright. During this motion, and depending upon whether or not the front wheels 24, 26 are off the ground, the front wheels 24, 26 will move backward along the floor toward the operator 102, as the bottom exterior surface 52 of the spout 58 engages the rim 72 of the toilet bowl 74 and the operator 102 raises the rear wheels 20, 22 of the container 10 up and off of the floor. Depending upon the amount of cleaning solution in the liquid reservoir 42, cleaning solution will begin to drain from the liquid reservoir 42, through the pour spout 58, and into the toilet bowl 74 during this lifting movement by the operator 102. In order to drain the liquid reservoir 42 fully, the operator 102 should continue to exert an upward and possibly forward force on the lever arm 18 until the planar front wall 44 of the container body 12 is in a substantially horizontal orientation, as shown in phantom in FIG. 3, and as shown in FIG. 4. If the user 102 chooses, and as shown in FIG. 3, he or she optionally may position a portion of a hand in the gap 156 between the storage compartment bottom wall 136 and the container body interior upper wall 158, and exert an upward force from this position as well; although, in most situations, this likely would not take full advantage of the mechanical leverage created by use of the lifting lever arm 18. Depending upon the amount of the cleaning solution to be drained, the speed with which the operator chooses to drain the cleaning liquid, and the shape of the particular toilet rim being used, as shown in FIG. 4, the front wall 44 of the container body 12 likely will move somewhat forward across the rim 72 of the toilet bowl 74. And, as the front wall 44 moves somewhat forward across the toilet bowl rim 72, the area of contact between the container body 12 and toilet bowl 74 increases, as shown by the cross hatching in FIG.4, thereby maintaining the stability of the container 10 during the draining process. If desired, the container 10 even may be rotated slightly past the 90° rotation point shown in FIGS. 3 and 4, in order to direct any residual cleaning solution from the interior surface 132 of the front wall 44 toward the spout 58. Once the operator 102 has drained the cleaning liquid from the container 10 into the toilet bowl, the operator 102 simply exerts a slight backward force on the lifting lever arm 18, and slowly lowers the lever arm 18 while allowing gravity to return the container 10 to its horizontal position on the floor.

Figure 8:
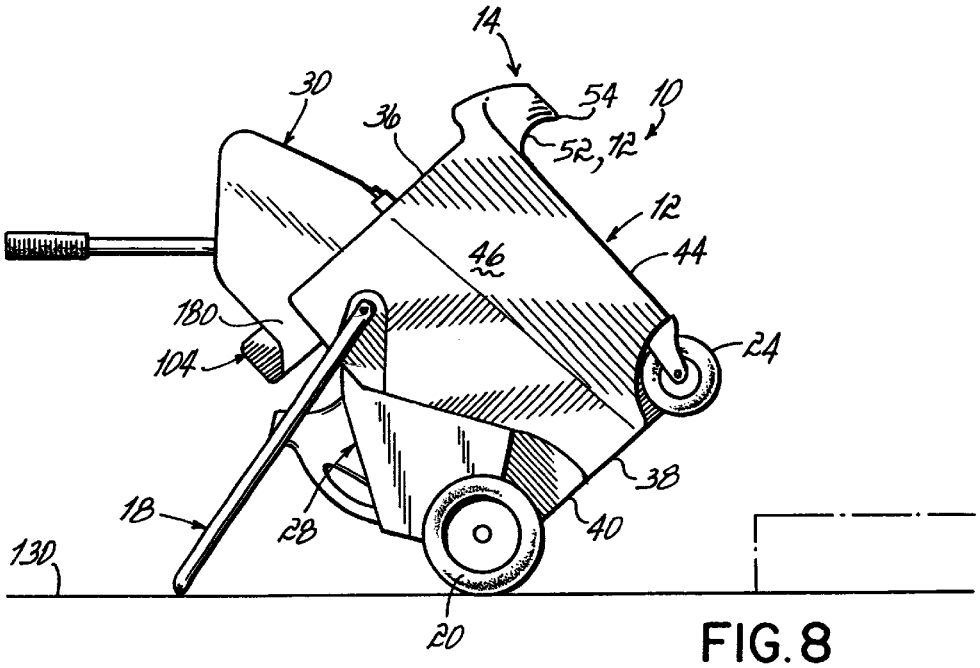
FIG. 8 is another side view of the container and wringer of FIG. 1.

As shown in FIG. 8, the lifting lever arm 18 also serves as a bracing bar if the container 10 is rotated backward, with the front of the container raised up in the air. This aspect provides an added safety feature if an operator chooses to elevate the front end, such as, for inspection purposes, or the like.

Figure 9:
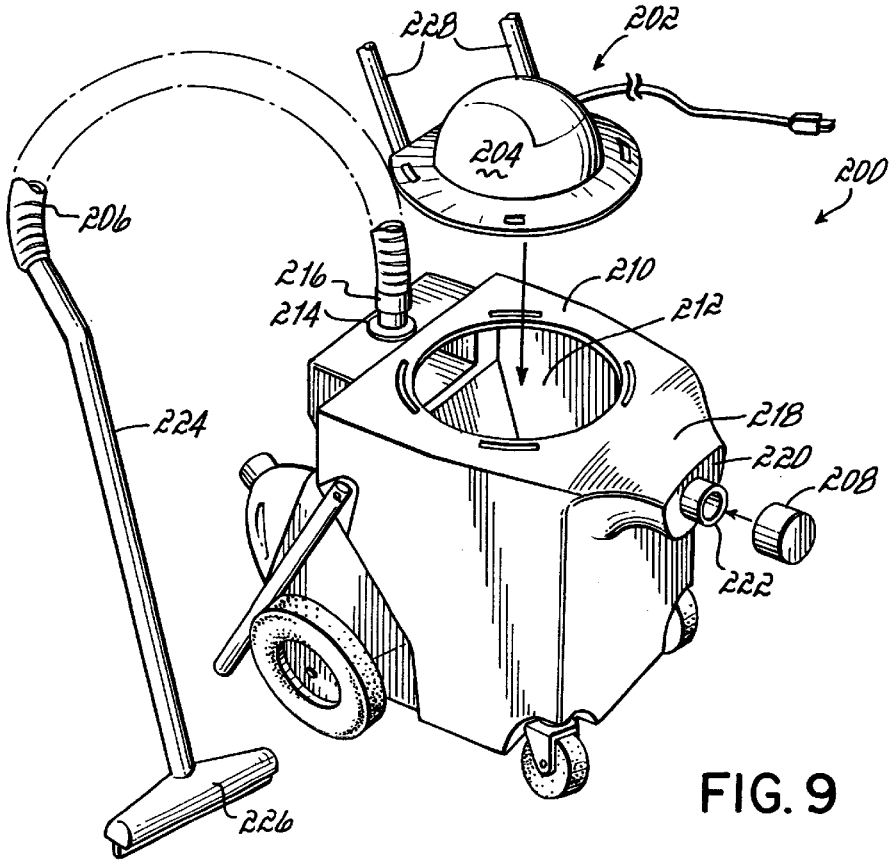
FIG. 9 is a perspective view of another version of the ergonomic, liquid-transport container.

With reference to FIG. 9, in a further aspect, an alternate version of the ergonomic, liquid-transport container 200 is shown in which the container 200 includes a wet/dry vacuum assembly 202. The assembly includes an attachable wet/dry vacuum power unit 204, a vacuum hose 206, and a sealing member 208. In the version of FIG. 9, the container 200, itself, includes a top wall 210 having a first opening 212 which is circular in shape, and which is capable of forming a releasable seal with the wet/dry vacuum power unit 204. The top wall 210 of the container 200 further includes an inlet port 214 adapted to connect to the inner end 216 of the vacuum hose 206. With regard to the spout 218, the outer end 220 of the spout 218 has a hollow cylindrical projection 222 adapted to receive the sealing member 208, or to receive the inner end 216 of the vacuum hose 206. In the latter situation, the sealing member 208 is releasably secured to the inlet port 214. As shown in FIG. 9, the components of the wetdry vacuum assembly 202 are arranged so as to operate the container in a vacuum mode, with the outer end of the vacuum hose 206 being connected to a wand 224, and a cleaning-tool 226 such as, for example, a squeegee tool, a conventional vacuuming tool, or the like. The wet/dry vacuum power unit 204, itself, includes not only a vacuum motor (not shown), but also an upper handle 228, which also serves as a convenient hose wrap for storing the vacuum 206 hose when it is not being used.

The ergonomic, liquid-transport container, according to the principles of the present invention, may be made using any of a number of different conventional manufacturing techniques, as readily will be appreciated by those of ordinary skill in the art upon reading this detailed description of the drawings. In one particular method of manufacture, the container body and storage compartment are rotationally molded as a single unit. Advantageously, during this process, threaded inserts may be molded into the container body wherever various container elements are to be subsequently screwed onto the container body. Although the process of forming and using such inserts will be appreciated by those of ordinary skill, additional details regarding this aspect of the rotational molding process may be found in copending U.S. patent application Ser. No. 09/108,411 entitled "MULTI-FUNCTIONAL CLEANING MACHINE" and filed on Jul. 1, 1998. A further example of one of the numerous ways in which the container body and storage compartment may be formed is the use of a conventional blow molding process.

Once the container body/storage compartment "part" has been formed, the storage compartment may be separated from the container body by a band saw machine, and any excess plastic material may be removed by a routing machine. At this point, the casters, non-caster wheels, lifting lever arm, storage compartment, and support member may be attached to the container body using bolts which thread into the inserts which previously have been molded into the container body. In addition, openings may be drilled adjacent the bottom wall portion of the storage compartment, the axle may be threaded through these openings, and the non-caster wheels may be attached to the axle. Although any suitable caster wheels and non-caster wheels may be used, beneficially the caster wheels are 4 inches in diameter, and the non-caster wheels are 6 inches in diameter. These dimensions are in stark contrast to the 2–3 inch dimensions of caster wheels used with traditional liquid-transport devices, and serve to minimize, and even prevent, tipping of the container, or spillage of liquid from the container, as the ergonomic container is driven from one location to another.

Although the various components of the ergonomic, liquid-transport container may be made from any of a number of different suitable materials as will be appreciated by those of ordinary skill in the art, the container body, spout, and storage compartment beneficially are made using a lightweight plastic, such as, for example, polyethylene. In addition, the lifting lever arm and the support member beneficially may be made from any of a number of suitable metals or metal alloys. The other components and parts of the ergonomic, liquid-transport container may be formed of conventional materials, as will be appreciated by those of ordinary skill. Regardless of the material or materials used to form the container body and the bottom exterior surface of the spout, it is particularly advantageous to use a non-marking, non-scratching plastic for the container body front wall and for the bottom exterior surface of the spout, so that the particular receptacle, including the rim of the receptacle, will not be marked or scratched by the container. With regard to the wringer assembly, any appropriately sized wringer assembly may be used in combination with the ergonomic, liquid-transport container. One particularly beneficial wringer is the universal down-pressure wringer from Marino Manufacturing Company of Concord, Ontario, Canada. This wringer accommodates numerous cleaning tools, including mops ranging in size from 12 ounce mops to 32 ounce mops. Moreover, the down-pressure feature is quite efficient in removing moisture and soil from a dirty cleaning tool.

While the present invention has been illustrated by description of a few select versions, and while the illustrative versions have been described in considerable detail, it is not the intention of the inventor to restrict, or in any way limit, the scope of the appended claims to such detail. Additional advantages and modifications readily will appear to those of ordinary skill in the art. By way of example, the container may include one or more relatively thin projecting members extending forward from the container front wall, with each such projecting member having a hook-shaped bottom exterior surface for hooking onto the lip of a draining receptacle, as is shown, for example, in Provisional Application No. 60/101,641, entitled "MOBILE, LIQUID-TRANSPORT CART WITH ERGONOMIC DESIGN FEATURES", and filed on Sep. 24, 1998.

And, with regard to the lifting lever arm, by way of example, the lifting lever arm may be designed so as to slidingly connect the lever arm to the container body, thereby enabling an operator to adjustably slide the lever arm such, that the back bar portion is oriented in any of a number of different positions relatively close to, or far away from, the back wall of the container body, as shown in Provisional U.S. patent application Ser. No. 60/101,641. Alternatively, the lifting lever arm may be designed so as to have a lift mode and a push mode, by forming a longitudinal slot toward the inner end of a generally U-shaped lifting lever arm, and forming corresponding recesses in the walls of the container body, such that the lifting lever arm may be adjusted to lift mode from push mode, as shown in Provisional U.S. patent application Ser. No. 60/101,641. In addition, by way of example, a version of the container having a wet/dry vacuum-blower assembly may be formed as shown and described in Provisional U.S. patent application Ser. No. 60/101,641. Accordingly, as should be apparent, departures may be made from the detailed description of the drawings discussed above, without departing from the spirit or scope of the inventor's general inventive concept.

What is claimed is:

1. A liquid-transport container, comprising:

a container body including a liquid reservoir, a front, and a back;

a projecting lip extending from the front, the projecting lip constructed and arranged to convey a liquid from the liquid reservoir into a receptacle;

a surface extending from the container body and protecting beyond the front, the surface constructed and arranged to contact and pivot about a rim of a receptacle, thereby facilitating the conveyance of a liquid from the liquid reservoir into a receptacle; and a lever handle connected to the container body, the lever handle constructed and arranged to have adjustable movement and at least one braced position, the one braced position being a position in which the lever handle is restricted from free pivotal movement to the front of the container body when at least a portion of the lever handle extends beyond the back of the container body.

2. The container of claim 1 wherein the surface has a width and is substantially planar across the width.

3. The container of claim 1 wherein the surface has an outer end which is at least about two inches from the front of the container body.

4. The container of claim 1 wherein the surface has an outer end, and the surface tapers from the front of the container body to the outer end.

5. The container of claim 1 wherein the container body has an upper end and a lower end, and at least a part of the front of the container body between the projecting lip and the lower end is substantially planar.

6. The container of claim 1 wherein the surface includes a substantially smooth curve.

7. The container of claim 6 wherein the radius of the substantially smooth curve is about one and one-half inch.

8. The container of claim 1 wherein the container includes a projection extending from the front of the container body, the projection having a bottom wall portion and an outer end.

9. The container of claim 8 wherein the front includes a bottom end, the projection bottom wall portion further having an interior surface, the interior surface curving toward the bottom end as the projection bottom wall approaches the front of the container body.

10. The container of claim 9 wherein the projection further includes a first sidewall portion and a second oppositely disposed sidewall portion.

11. The container of claim 10 wherein the container body further includes a first side and a second side, and each of the projection first and second sidewall portions has a sidewall interior surface, the first sidewall interior surface curving toward the first side and the second sidewall interior surface curving toward the second side as the projection first and second sidewalls approach the front of the container body.

12. The container of claim 8 wherein the projection further includes a first sidewall portion and a second oppositely disposed sidewall portion.

13. The container of claim 12 wherein the projection further includes a top wall portion.

14. The container of claim 13 wherein the bottom wall portion tapers from the front of the container body to the outer end of the projection.

15. The container of claim 14 wherein the sidewall portions taper from the front of the container body to the outer end of the projection.

16. The container of claim 8 wherein the projecting lip includes the projection.

17. The container of claim 1 wherein the container body includes a peripheral sidewall, and a peripheral upper end adjacent the peripheral sidewall, the peripheral sidewall having a front, a back, a first side, and a second oppositely-disposed side, the peripheral upper end having an opening which accesses the liquid reservoir and which is adapted to accept a portion of a wringer; and a support member extending between, and connected to, the first and second sides, the support member adapted to support an edge of a wringer.

18. The container of claim 17 wherein the support member is spaced from the back of the peripheral sidewall sufficient to support an edge of a wringer when a wringer is positioned adjacent the back of the peripheral sidewall.

19. The container of claim 17 in combination with a wringer.

20. The container of claim 1 wherein the surface includes an exterior surface of the projecting lip.

21. The container of claim 1 wherein the lever handle is pivotally connected to the container body.

22. The container of claim 1 wherein the lever handle is non-integrally connected to the container body.

23. A liquid-transport container, comprising:

a container body including a liquid reservoir, a front, and a back;

a projecting lip extending from the front, the projecting lip constructed and arranged to convey a liquid from the liquid reservoir into a receptacle; and a lever handle connected to the container body, the lever handle constructed and arranged to have adjustable movement and at least one braced position, the one braced position being a position in which the lever handle is restricted from free pivotal movement to the front of the container body when at least a portion of the lever handle extends beyond the back of the container body.

24. The container of claim 23 wherein the lever handle has an outer end, and the distance between the outer end and the back of the container body is adjustable.

25. The container of claim 23 wherein the lever handle is pivotally connected to the container body.

26. The container of claim 23 wherein the lever handle has an extended position and a non-extended position.

27. A container, comprising:

a container body including a liquid reservoir, a peripheral sidewall, and a peripheral upper end adjacent the peripheral sidewall, the peripheral sidewall having a from and back; and a projecting lip extending from the front of the peripheral sidewall, the projecting lip having a bottom exterior surface and an outer end, the peripheral upper end further having a first opening which accesses the liquid reservoir and which is adapted to accept a portion of a wringer, the peripheral upper end also having a top panel adjacent the back of the peripheral sidewall, the top panel including a second opening, the second opening being positioned between the first opening and the back of the peripheral sidewall, the second opening accessing the liquid reservoir and adapted to receive a liquid fill hose.

28. A container system, comprising:

a container, comprising:

a container body including a liquid reservoir and a front; and a projecting lip extending from the front of the container body, the projecting lip having a bottom exterior surface and an outer end; and a wringer including a cleaning-tool stowing assembly comprising a strap having a first end and a second end, the first end being secured to a portion of the wringer, and the second end being releasably securable to an adjacent portion of the wringer.

29. A method of pouring a liquid from a liquid-transport container into a receptacle having a rim, the liquid-transport container comprising: a container body including a front, a back, and a liquid reservoir having a liquid; a projecting lip extending from the front, the projecting lip constructed and arranged to convey a liquid from the liquid reservoir into a receptacle; a surface extending from the container body and projecting beyond the front, the surface constructed and arranged to contact and pivot about a rim of a receptacle, thereby facilitating the conveyance of a liquid from the liquid reservoir into a receptacle; and a lever handle connected to the container body, the lever handle constructed and arranged to have adjustable movement and at least one breed position, the one braced position being a position in which the lever handle is restricted from free pivotal movement to the front of the container body when at least a portion of the lever handle extends beyond the back of the container body, the method comprising the steps of:

contacting the surface with the rim of the receptacle; and elevating the back of the container body, thereby pouring at least a portion of the liquid from the liquid reservoir into the receptacle.

30. The method of claim 29 wherein the receptacle is a toilet bowl.

31. The method of claim 39 wherein the surface includes a substantially smooth curve.

32. The method of claim 29 wherein the elevating step includes exerting an upward force on the handle arm.

33. The method of claim 29 wherein the lever handle has an outer end, an extended position, and a non-extended position, with the outer end of the lever handle being further from the back of the container body in the extended position than in the non-extended position, the method further comprising the step of moving the handle to the extended position.

34. The method of claim 29 wherein the container further includes a first wheel and a second wheel, the method further comprising the step of moving the container toward the rim of the receptacle.

35. The method of claim 34 wherein the container further includes a third wheel, the moving step including rolling the container toward the rim of the receptacle.

36. The method of claim 29 wherein the container body further includes three wheels, at least one of the wheels being a non-caster wheel, and at least another of the wheels being a caster wheel, the method further comprising the step of rolling the container toward the rim of the receptacle.

37. A liquid-transport container, comprising:

a container body including a liquid reservoir, a front and a back ;

a projecting lip extending from the front, the projecting lip constructed and arranged to convey a liquid from the liquid reservoir into a receptacle;

a surface extending from the container body and projecting beyond the front, the surface constructed and arranged to contact and pivot about a rim of a receptacle wall, thereby facilitating the conveyance of a liquid from the liquid reservoir into a receptacle;

three wheels, at least one of the wheels being a non-caster wheel, and at least another of the wheels being a caster wheel; and a lever handle connected to the container body, the lever handle constructed and arranged to have movement and at least one braced position, the one braced position being a position being a position in which the lever handle is restricted from free pivotal movement to the front of the container body when at least a portion of the lever handle extends beyond the back of the container body.

38. The container of claim 37 further including a fourth wheel.

39. The container of claim 38 wherein two of the wheels are non-caster wheels and two of the wheels are caster wheels.

40. The container of claim 39 wherein the container body includes a back, the two non-caster wheels being positioned near the back of the container body, and the two caster wheels being positioned near the front of the container body.

* * * * *

UNITED STATES PATENT AND TRADEMARK OFFICE

CERTIFICATE OF CORRECTION

PATENT NO. : 6,283,170 B1
DATED : September 4, 2001
INVENTOR(S) : Robert S. Robinson It is certified that error appears in the above-identified patent and that said Letters Patent is hereby corrected as shown below:

Column 1,
Line 43, “aftermpt” should read -- attempt --.

Column 2,
Line 52, “sur face” should read -- surface --.

Column 3,
Line 12, “1½ inch” should read -- 1½ inches --.

Column 5,
Line 6, “referred to as a lifting a lever arm, with the lifting a lever arm being constructed” should read -- referred to as a lifting lever arm, with the lifting lever arm being constructed --.
Line 24, “one third” should read -- one-third --.

Column 7,
Line 24, “Fig. 4 is front view” should read -- Fig. 4 is a front view --.

Column 8,
Line 20, “1½ inch” should read -- 1½ inches --.
Line 49, “Figs, 3,4,” should read -- Figs. 3,4, --.
Line 64, “end of the of the spout, and” should read -- end of the spout, and --.

Column 10,
Line 33, “the reservoir 42” should read -- the reservoir 42. --.

Column 11,
Line 18, “sidewall 150” should read -- sidewall 150 --.
Line 31, “t he” should read -- the --.

Column 12,
Line 3, “container” should read -- container 10 --.

Column 13,
Line 43, “the lever arm 18 while allowing” should read -- the lever arm 18, while allowing --.

Column 14,
Line 2, “wetdry” should read -- wet/dry --.

UNITED STATES PATENT AND TRADEMARK OFFICE

CERTIFICATE OF CORRECTION

PATENT NO. : 6,283,170 B1
DATED : September 4, 2001
INVENTOR(S) : Robert S. Robinson It is certified that error appears in the above-identified patent and that said Letters Patent is hereby corrected as shown below:

Column 15,
Lines 57-58, “protecting” should read -- projecting --.

Column 18,
Line 3, “breed” should read -- braced --.
Line 13, “The method of claim 39” should read -- The method of claim 29 --.
Line 16, “handle arm” should read -- lever handle --.
Lines 50-52, “handle constructed and arranged to have movement and at least one braced position, the one braced position being a position being a position in which the lever” should read -- handle constructed and arranged to have adjustable movement and at least one braced position, the one braced position being a position in which the lever --.

Signed and Sealed this

Twentieth Day of August, 2002

*Attest:*

*Attesting Officer*

JAMES E. ROGAN
*Director of the United States Patent and Trademark Office*